US007346940B1

(12) United States Patent
Liao

(10) Patent No.: US 7,346,940 B1
(45) Date of Patent: Mar. 25, 2008

(54) SHOWER CURTAIN ROD ASSEMBLY

(75) Inventor: Ying Feng Liao, Hemei Township, Changhua County (TW)

(73) Assignee: You Da Metal International Develop Co., Ltd., Changhua County (TW)

( * ) Notice: Subject to any disclaimer, the term of this patent is extended or adjusted under 35 U.S.C. 154(b) by 0 days.

(21) Appl. No.: 11/583,015

(22) Filed: Oct. 19, 2006

(51) Int. Cl.

| | |
|---|---|
| ***A47K 3/08*** | (2006.01) |
| ***A47H 1/10*** | (2006.01) |
| ***E04G 3/00*** | (2006.01) |
| ***A47F 5/00*** | (2006.01) |

(52) U.S. Cl. ..... 4/558; 4/557; 248/261; 248/282.1; 248/289.11

(58) Field of Classification Search ..... 4/557, 4/558, 610; 248/261, 262, 289.11, 282.1
See application file for complete search history.

(56) References Cited

U.S. PATENT DOCUMENTS

| | | | | |
|---|---|---|---|---|
| 2,011,662 | A * | 8/1935 | Thompson | 4/558 |
| 2,215,331 | A * | 9/1940 | Daniel | 248/251 |
| 4,754,504 | A * | 7/1988 | Cellini | 4/610 |
| 5,799,804 | A * | 9/1998 | Sharpe | 211/105.1 |
| 5,894,610 | A * | 4/1999 | Winter | 4/558 |
| 6,263,523 | B1 * | 7/2001 | Moore | 4/610 |
| 2005/0268394 | A1 * | 12/2005 | Monk et al. | 4/558 |

* cited by examiner

*Primary Examiner*—Gregory L. Huson
*Assistant Examiner*—Kristie A. Mahone
(74) *Attorney, Agent, or Firm*—Rosenberg, Klein & Lee

(57) ABSTRACT

A shower curtain rod assembly includes a frame fixed on a wall and a connection member has a connection tube which has one end connected with an end of a rod and a pivotable member is connected to the other end of the connection tube. The pivotable member is pivotably connected to the frame so as to set the direction that the connection tube is orientated. A cover has a through hole through which the connection tube extends. The connection tube is adjustable to be connected with a curved rod.

11 Claims, 14 Drawing Sheets

SHOWER CURTAIN ROD ASSEMBLY

FIELD OF THE INVENTION

The present invention relates to a shower curtain rod assembly and the direction of the rod can be adjusted.

BACKGROUND OF THE INVENTION

A conventional shower curtain assembly generally includes a rod which are usually composed of several sections so as to be connected between two opposite walls of the showering space. A plurality of rings are movably mounted on the rod and the shower curtain has a top end connected with the rings. The user can pull the shower curtain by moving the rings along the rod. However, the conventional shower curtain assembly is designed for use with rectangular shower space wherein a tub is located on the floor in the shower space and the tub has a straight wall so that the shower curtain is arranged to be pulled in straight direction. As shown in FIG. 17, when the tub 8 is not an oval tub and includes a curved wall, the conventional straight rod and the shower curtain are no longer suitable to be used for the tub with curved wall. Two special designed frames 82 are fixed on the two opposite walls 83 and a curved shower curtain rod 81 is connected between the two frames 82. A fixed angle 84 is defined between the curved shower curtain rod 81 and each of the two walls 83. The angle 84 is not adjustable.

FIG. 18 shows another frame unit 91 for a curved shower curtain rod, wherein the frame 91 includes two lugs 911 and a connection member 92 is pivotably connected between the two lugs 911. The connection member 92 is a T-shaped member and includes a first bar 911 and a second bar 922 which has two threaded holes 923 in two respective ends thereof. Two bolts 93 extend through the two lugs 911 of the frame 91 and are threadedly connected to the threaded holes 923 to set the direction that the first bar 921 is orientated. The shower curtain rod (not shown) is the connected between the two first bars 921 on the two frames 91. Nevertheless, the frames 91 include two lugs 911 which are deemed to be too old-fashioned and might be fit with the interior design needs.

Besides, when pull the shower curtain, the rings on the curtain usually moved along the rod so that gaps are defined between the walls and the curtain, water splashes out from the gaps.

The present invention intends to provide a connection for a shower curtain rod and includes a direction adjustable member which allows the shower curtain rod to be connected in a desired direction.

SUMMARY OF THE INVENTION

The present invention relates to a shower curtain rod assembly that comprises a connection member having a connection tube and a pivotable member respectively on two ends thereof and an end of a rod is connected to the connection tube. The pivotable member is pivotably connected to a protrusion on a frame on a wall. A shrink neck is connected between the pivotable member and the connection tube. A cover has a through hole through which the connection tube extends. The shrink neck and the connection tube are located outside of an outer surface of the cover.

The primary object of the present invention is to provide a shower curtain rod assembly which includes a direction adjustable connection member so as to be connected with a straight or curved rod.

Another object of the present invention is to provide a shower curtain rod assembly wherein the rings connected on the curtain can be well positioned at the connection members when the curtain is pulled.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
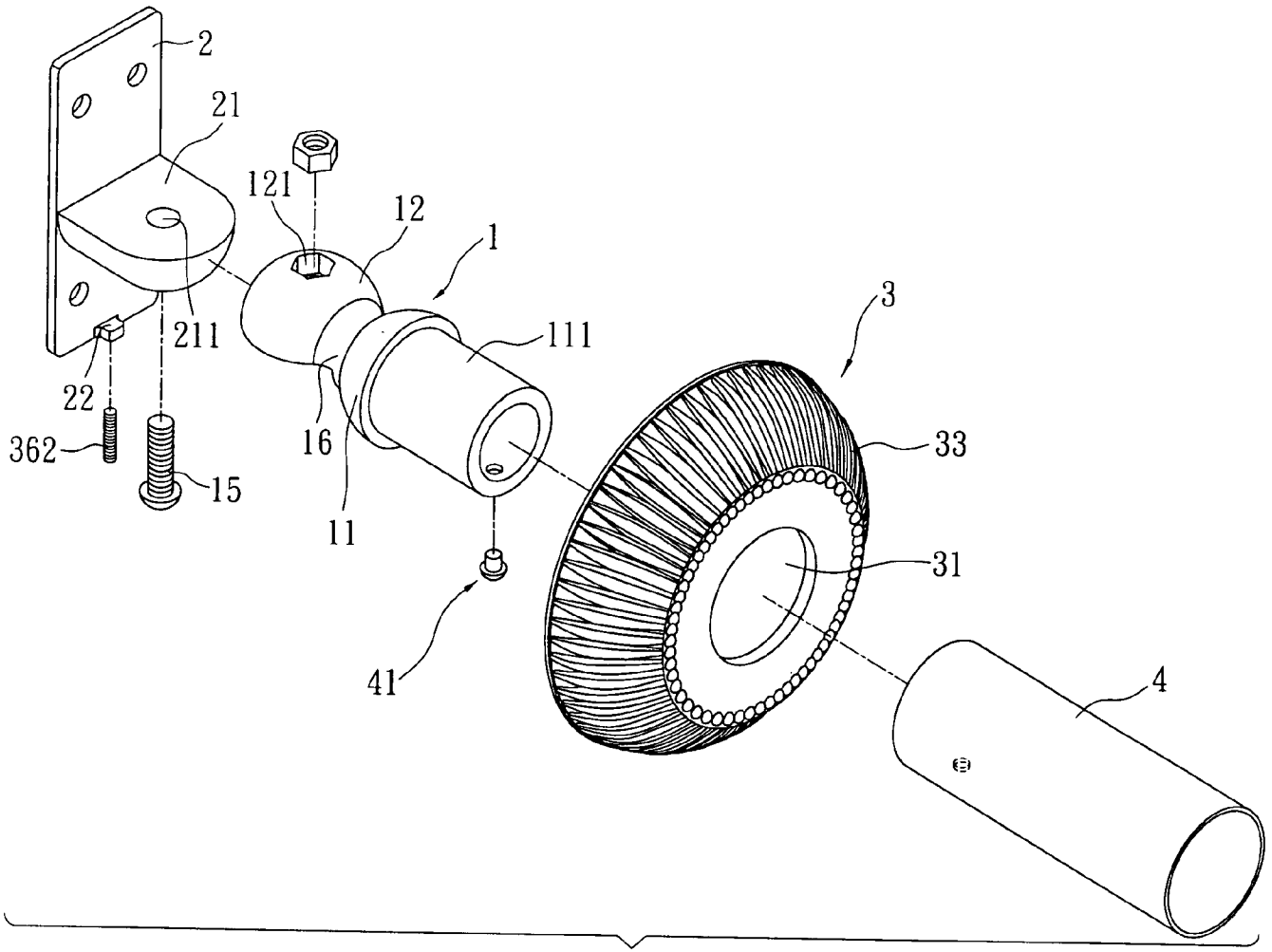
FIG. 1 is an exploded view to show the shower curtain rod assembly of the present invention.
Figure 2:
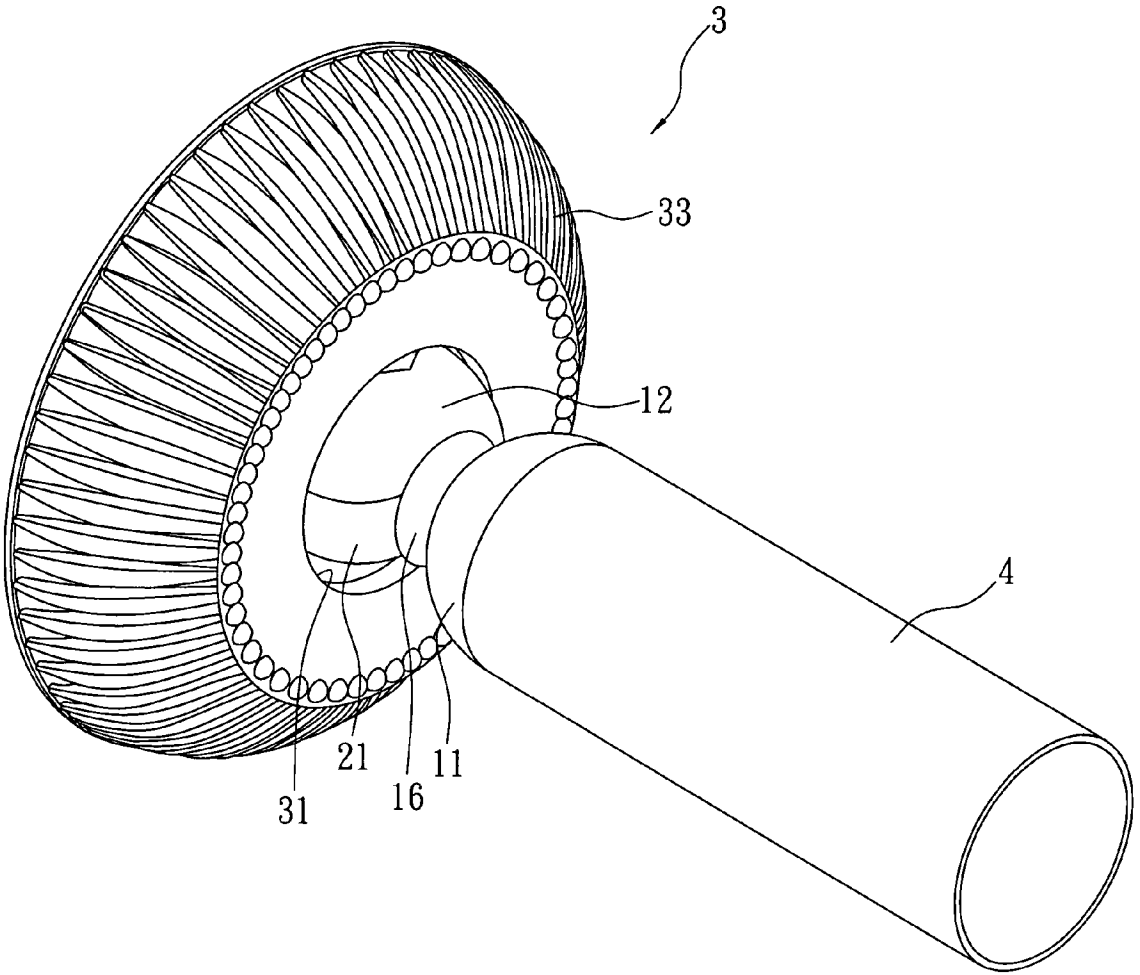
FIG. 2 is a perspective view to show the shower curtain rod assembly of the present invention.
Figure 3:
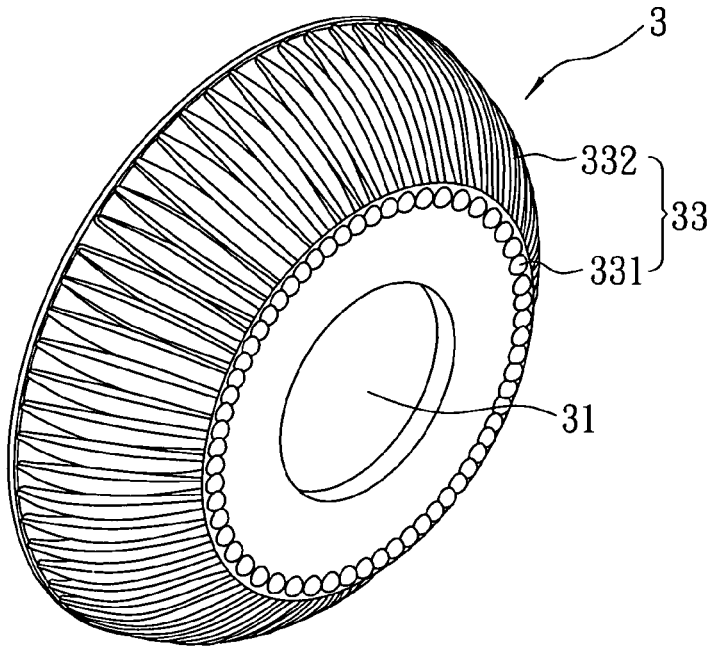
FIG. 3 is a perspective view to show the cover of the shower curtain rod assembly of the present invention.
Figure 4:
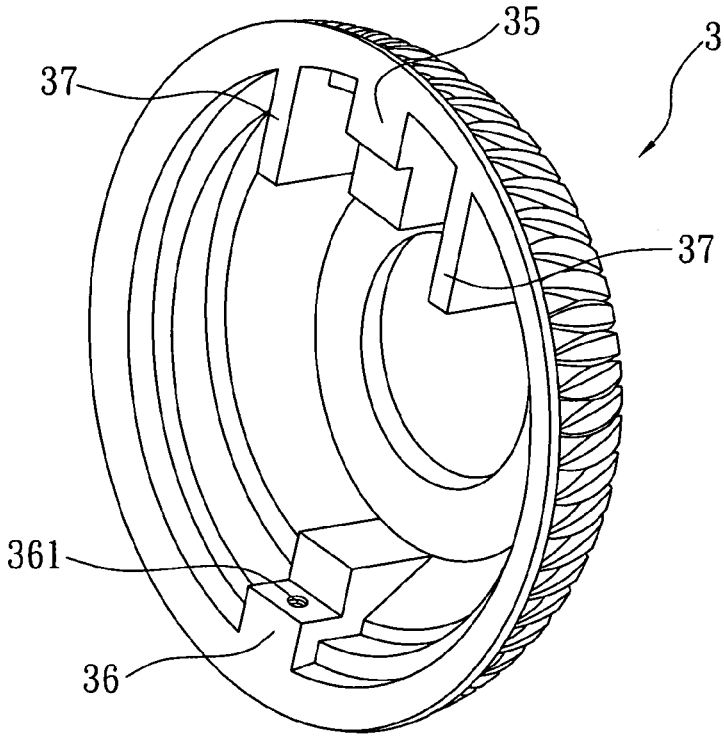
FIG. 4 shows the rear side of the cover of the shower curtain rod assembly.
Figure 5:
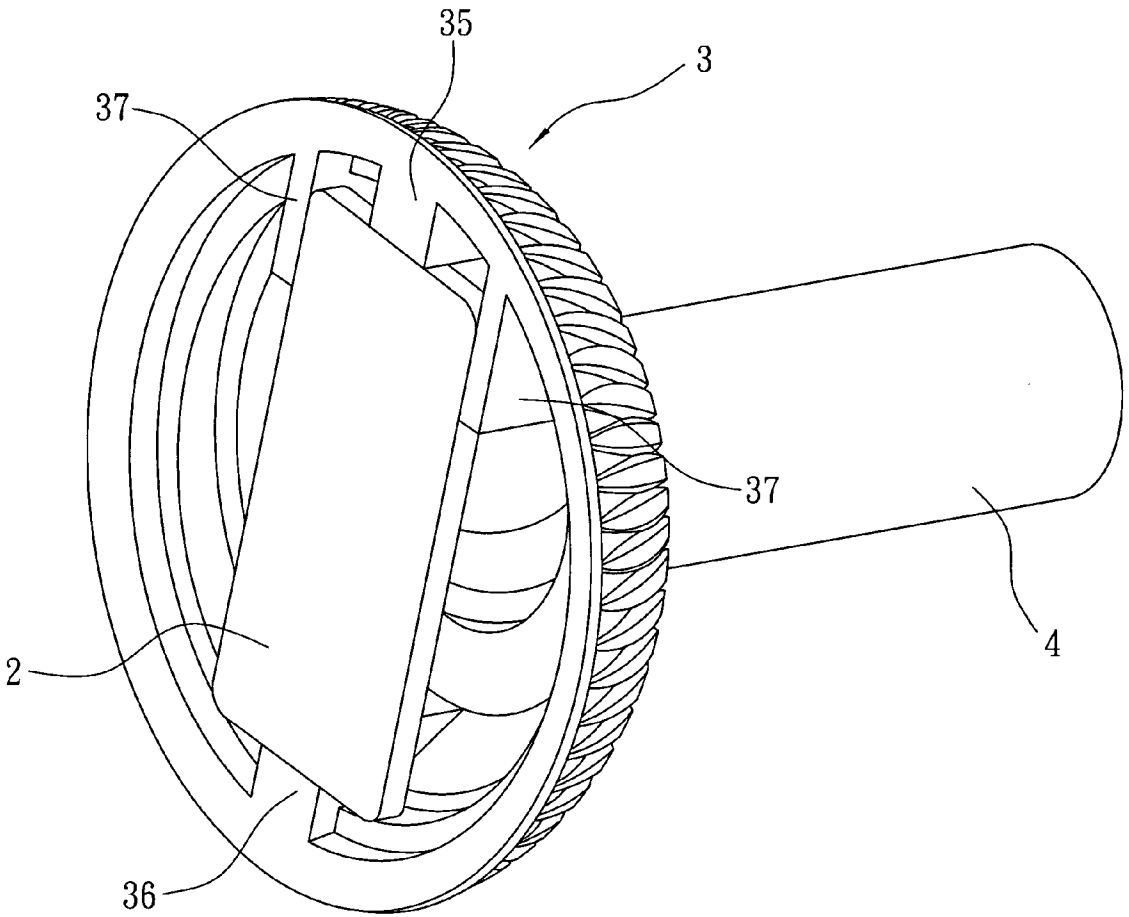
FIG. 5 shows the cover is mounted on the frame.
Figure 6:
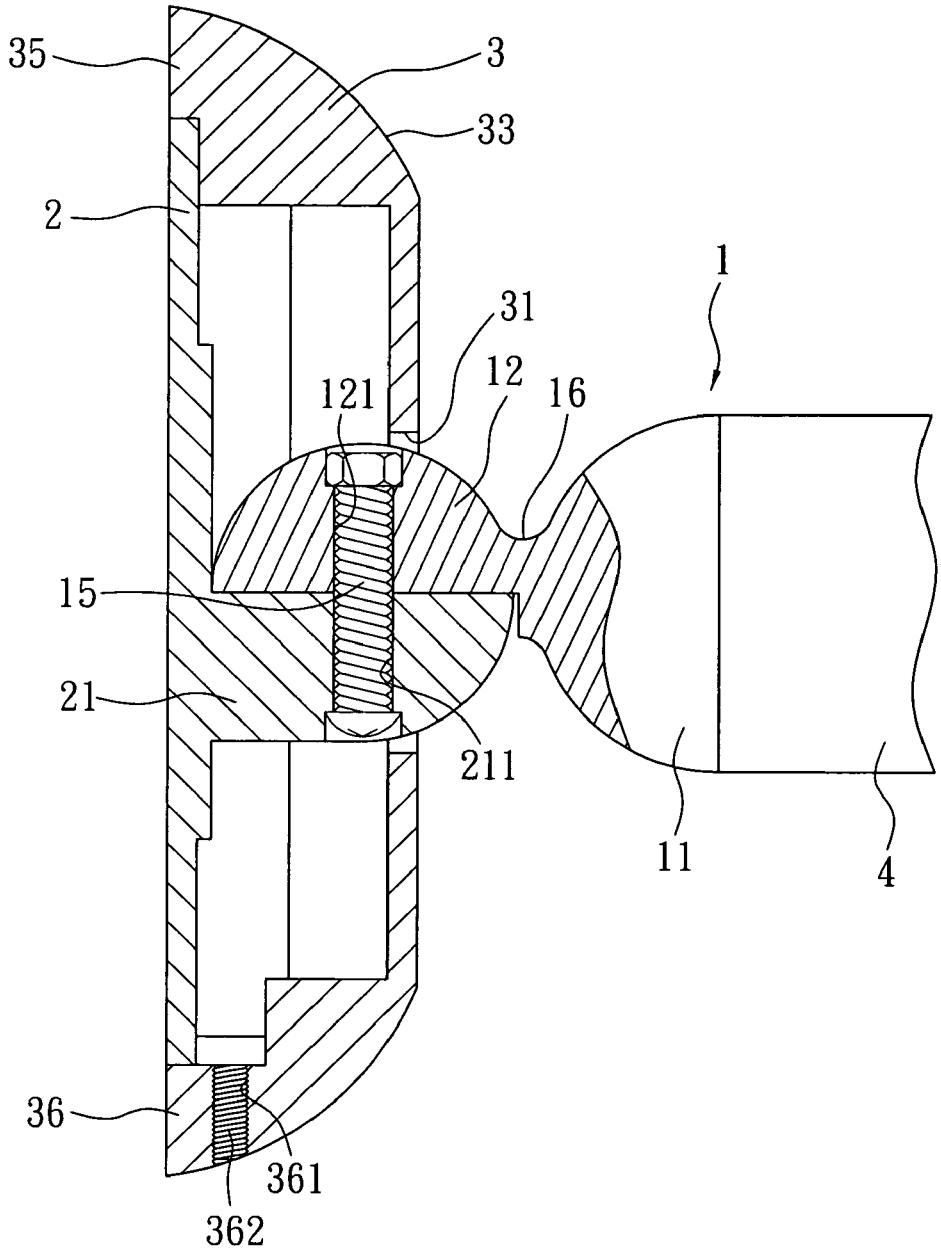
FIG. 6 is a cross sectional view of the connection of the connection tube, the frame and the cover.

Referring to FIGS. 1 to 6, the shower curtain rod assembly of the present invention comprises a connection member 1 which has a connection tube 11, a pivotable member 12 and a shrink neck 16 which is connected between the connection tube 11 and the pivotable member 12. The connection tube 11 has an extension portion 111 which has a diameter smaller than a diameter of the connection tube 11, and an end of a rod 4 is inserted into the extension portion 111 by extending a bolt 41 through a wall of the extension portion 111 so as to contact against the rod 4. A first hole 121 is defined through the pivotable member 12.

A frame 2 is fixed on a wall and has a protrusion 21, the protrusion 21 has a top flat surface which is matched with a flat surface defined in an underside of the pivotable member 12. A second hole 211 is defined through the protrusion 21 so that a bolt 15 extends through the first hole 121 and the second hole 21 and is engaged with a nut. A block 22 extends from the frame 2 and located beneath the protrusion 21.

A bowl-shaped cover 3 has a through hole 31 through which the connection tube 11 extends. The shrink neck 16 and the connection tube 11 are located outside of an outer surface 33 of the cover 3. A first stepped member 35 and a second stepped member 36 are formed on a rear side of the cover 3, wherein the first stepped member 35 is located between two clamp plates 37 on the cover 3 and a threaded hole 361 is defined in the second stepped member 36. Two sides of the frame 2 are clamped between the two clamp plates 37 and a bolt 362 threadedly extends through the threaded hole 361 and contacts against the block 22 so as to connect the frame 2 and the cover 3. The cover 3 has a plurality of beads 331 connected along a periphery of the through hole 31 and a plurality of ridges 332 extend radially from the periphery of the through hole 31 on the outer surface 33. Therefore, the frame 2 is hidden by the cover 3 and the beads 331 and the ridges 332 have proper decoration feature.

The direction of the connection tube 11 can be set by adjusting the pivotable member so that straight rod 4 or curved rod 4 can be used with the assembly.

Figure 15:
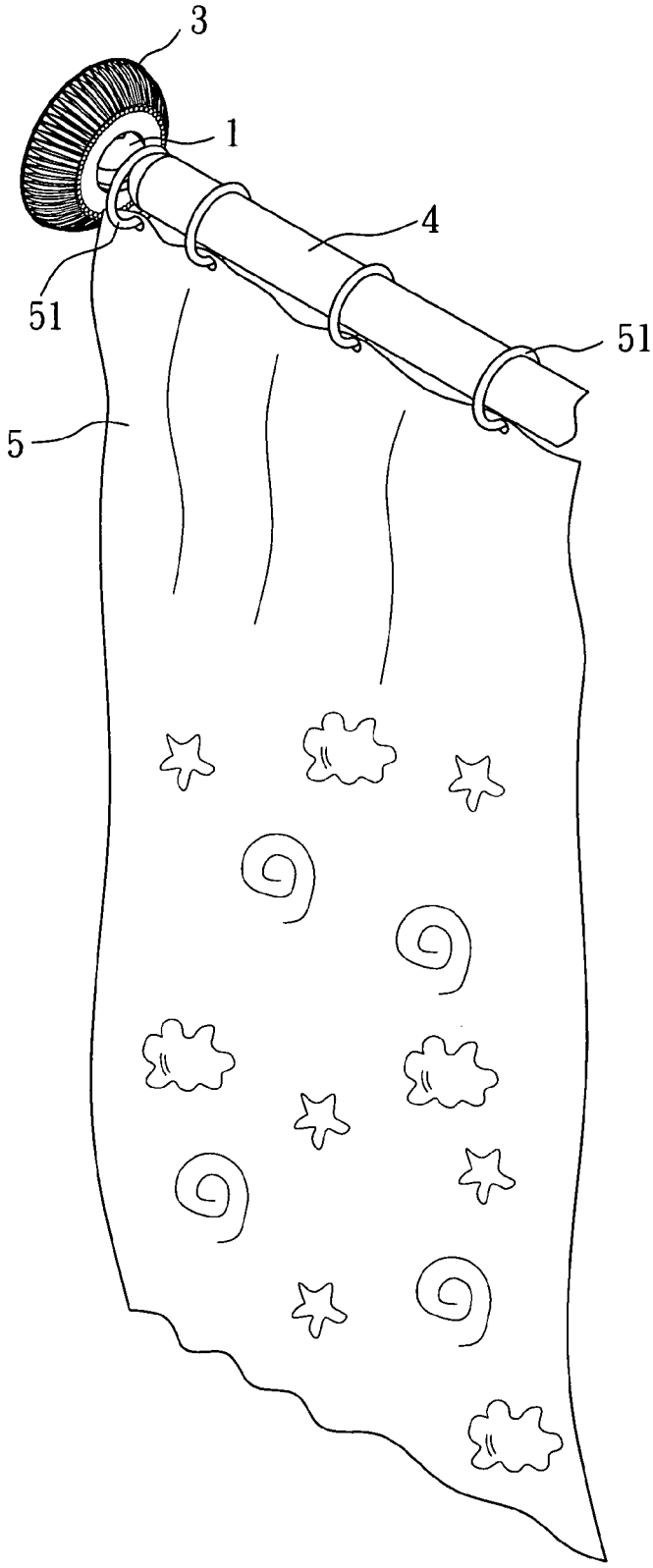
FIG. 15 shows that the ring is located at the shrink neck when the shower curtain is pulled.
Figure 16:
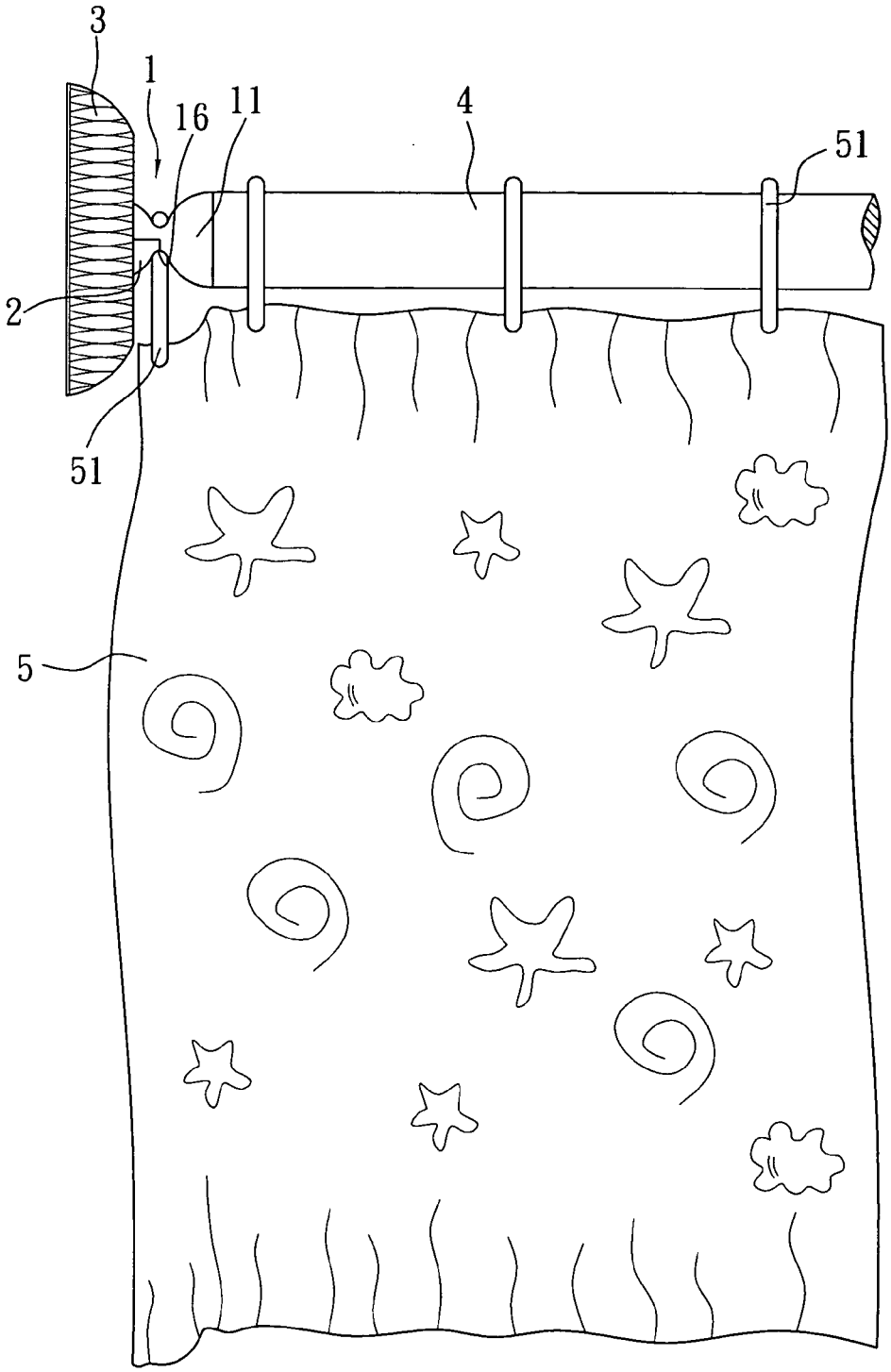
FIG. 16 is a front view of the ring at the shrink neck.
Figure 17:
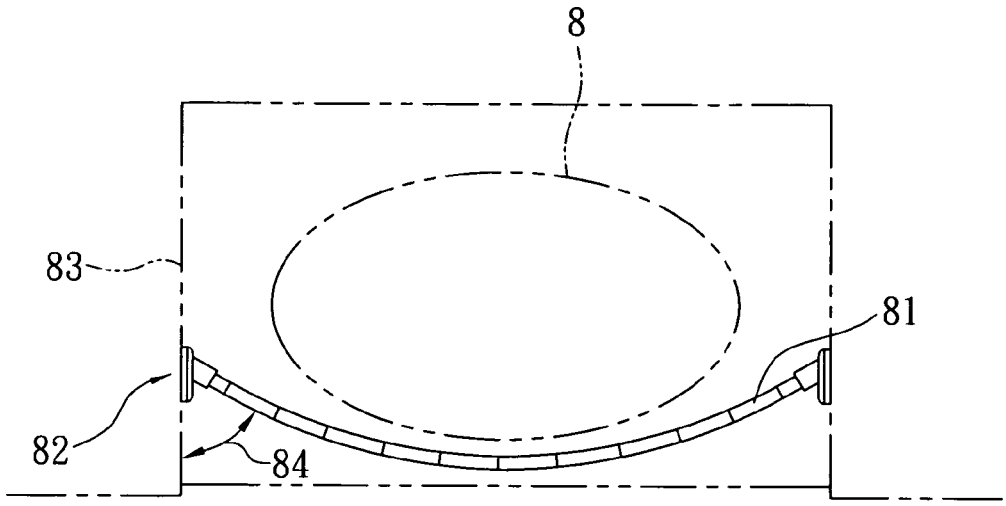
FIG. 17 PRIOR ART
FIG. 17 shows a conventional curved rod is used for the tub with a curved out wall.
Figure 18:
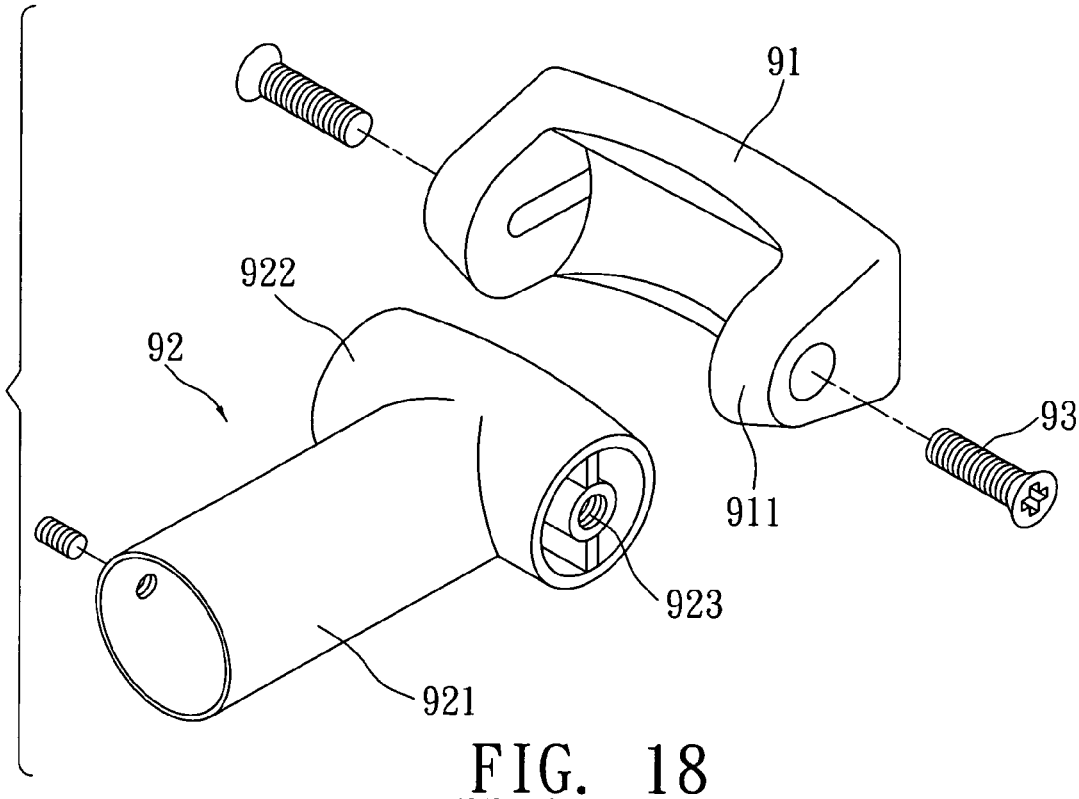
FIG. 18 PRIOR ART
FIG. 18 shows a conventional frame and a conventional connection member.

As shown in FIGS. 15 and 16, the rings 51 on the rod 4 are connected to the curtain 5 and the first ring 51 is well positioned at the shrink neck 16 so that when the user pulls the curtain 5, the first ring 51 does not move so as to maintain a side of the curtain 5 to be close to the wall.

Figure 7:
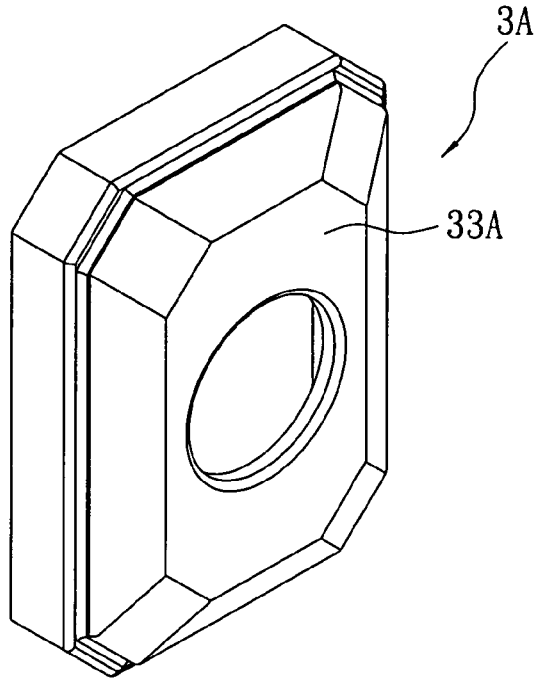
FIG. 7 shows a second embodiment of the cover of the shower curtain rod assembly.
Figure 8:
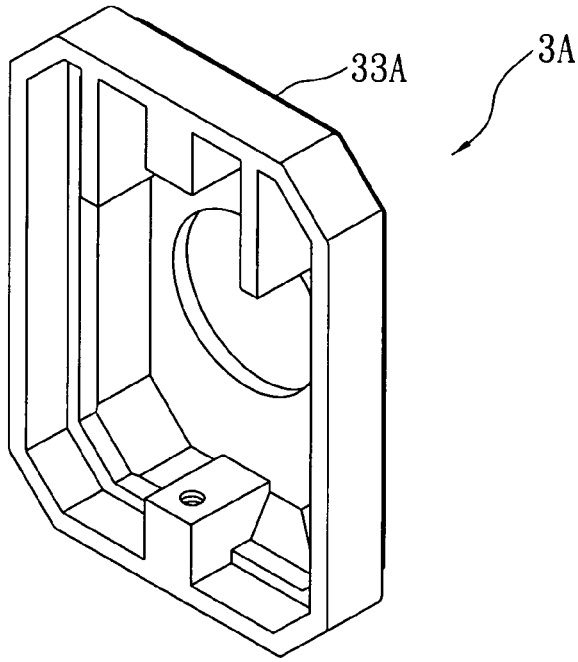
FIG. 8 shows a rear side of the cover in FIG. 7.
Figure 9:
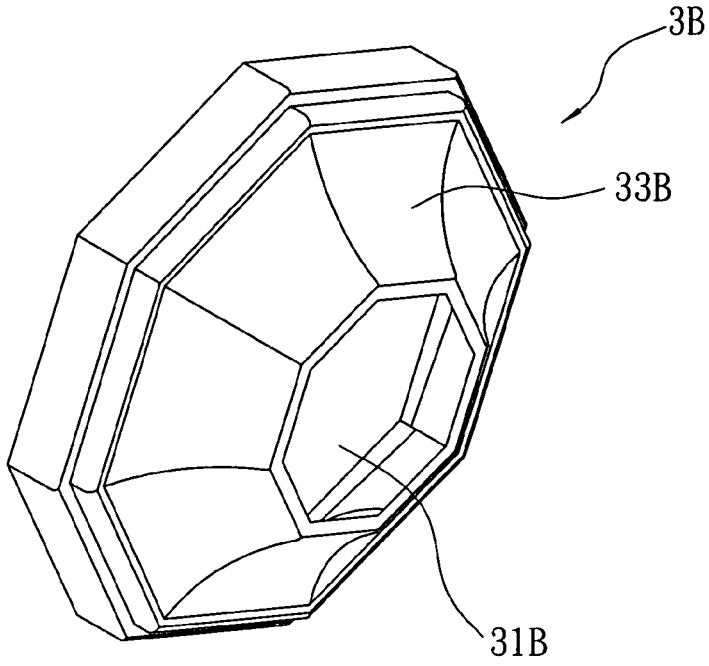
FIG. 9 shows a third embodiment of the cover of the shower curtain rod assembly.
Figure 10:
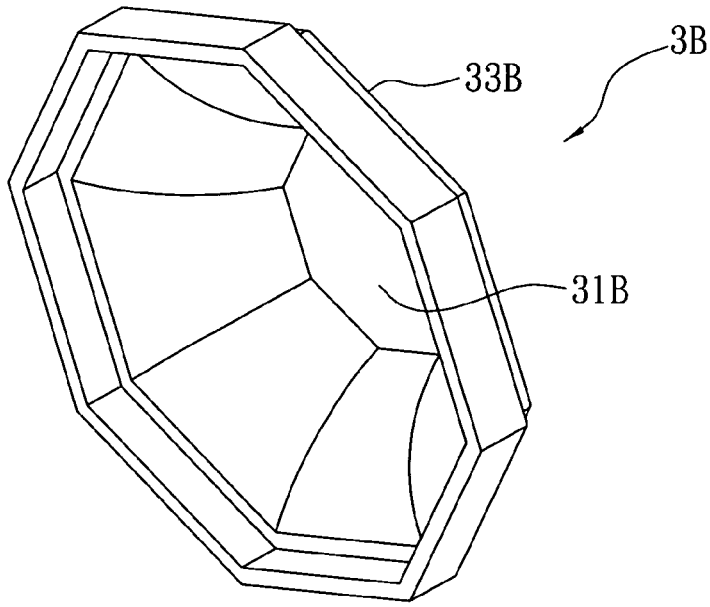
FIG. 10 shows a rear side of the cover in FIG. 9.

FIGS. 7 and 8 show a second embodiment of the cover 3A of the shower curtain rod assembly; wherein the cover 3A is a rectangular member and includes a plurality of reflection outer surface 33A. FIGS. 9 and 10 show a third embodiment of the cover 3B of the shower curtain rod assembly, wherein the cover 3B is an octagon-shaped member and the through hole 31B is an octagon-shaped hole.

Figure 11:
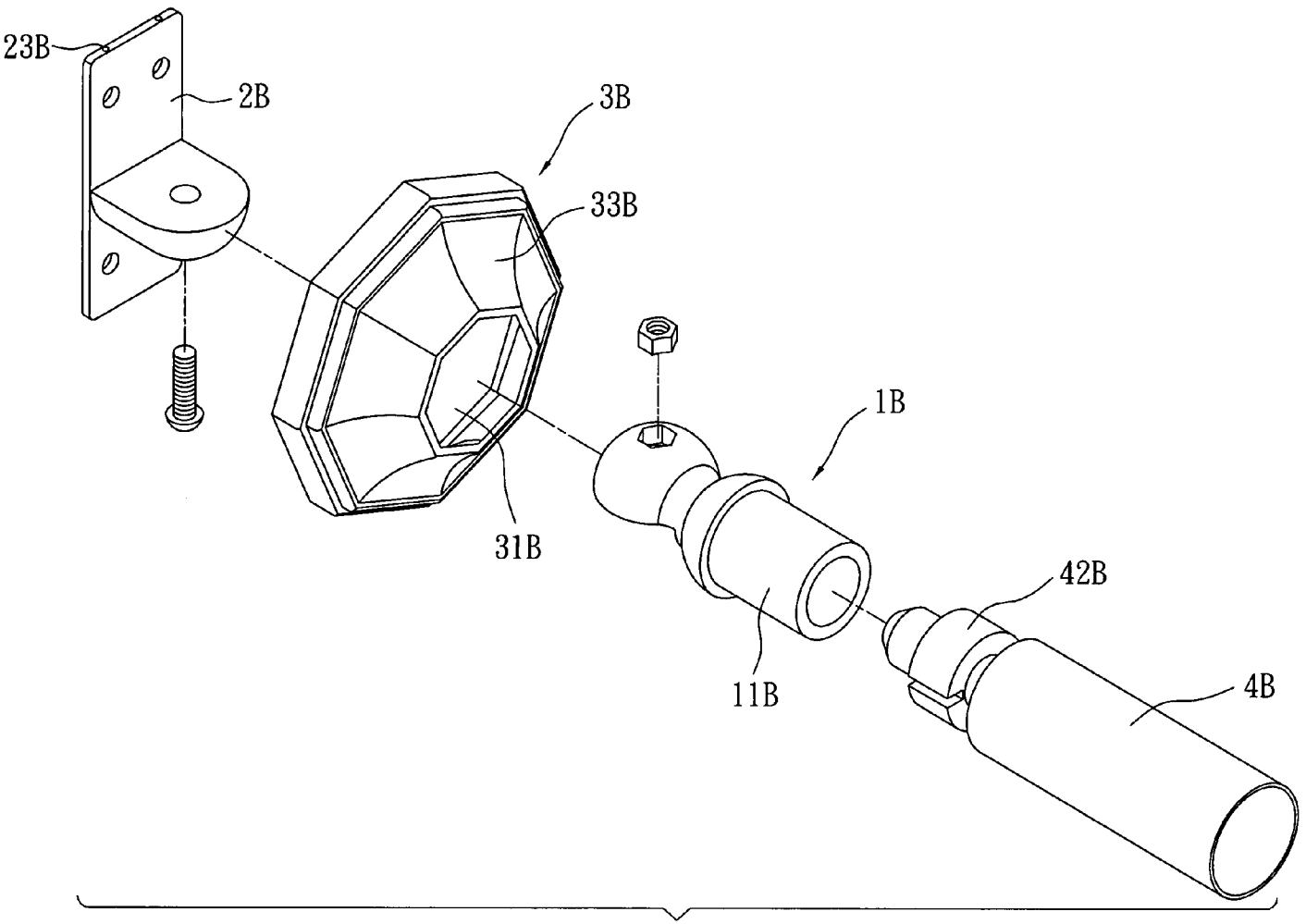
FIG. 11 is an exploded view to show yet another embodiment of the shower curtain rod assembly.
Figure 12:
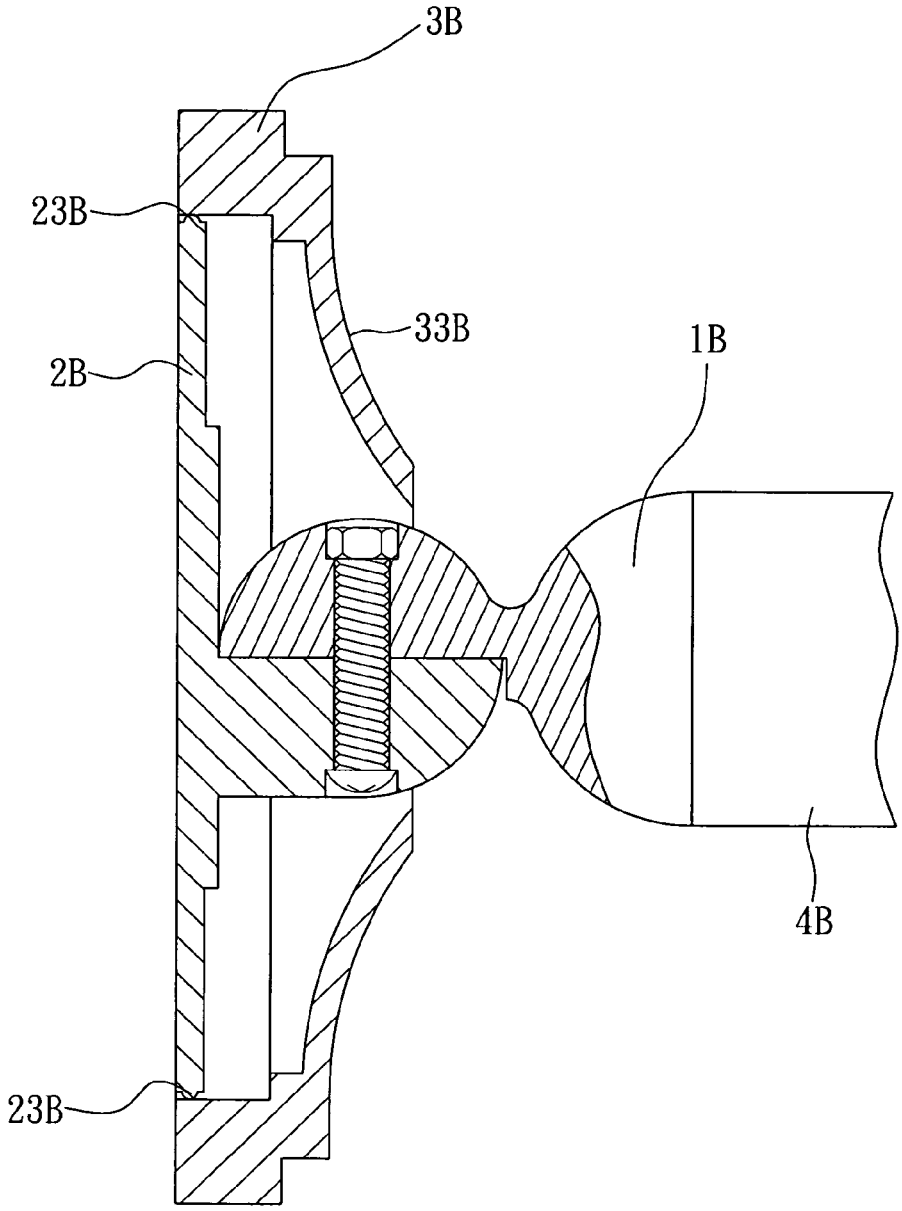
FIG. 12 is a cross sectional view of the connection of the shower curtain rod assembly in FIG. 11.

FIGS. 11 and 12 show yet another embodiment of the shower curtain rod assembly, wherein the frame 2B is a rectangular member and includes bosses 23B extending from one of sides of the frame 2B and the cover 3B includes a peripheral wall which is mounted to the frame 2B and the bosses 23B frictionally connect the peripheral wall. A secure member 42B has one end connected to an end of the rod 4B and the other end of the secure member 42*b* is inserted into the extension portion 111B of the connection tube 11B of the connection member 1B.

Figure 13:
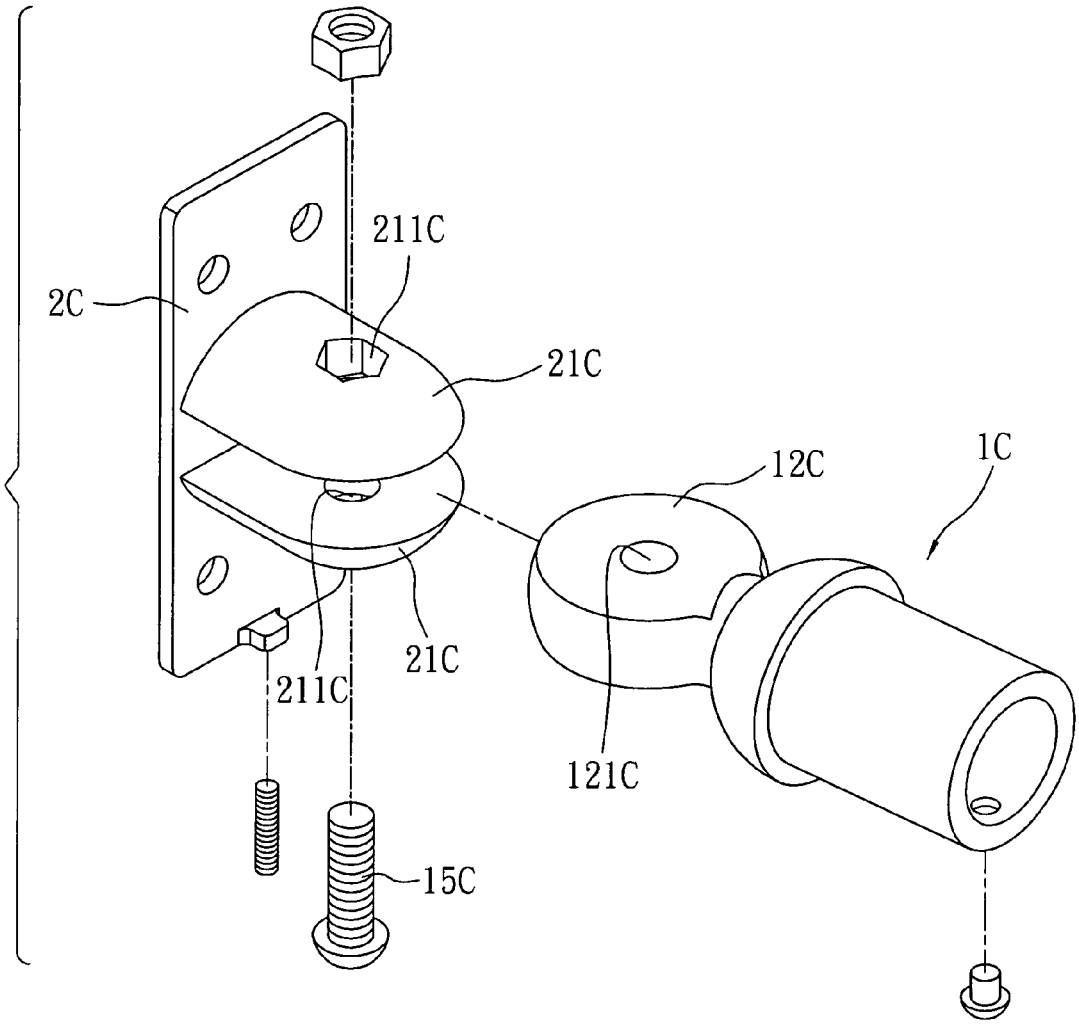
FIG. 13 shows a further embodiment of the shower curtain rod assembly.

FIG. 13 shows a further embodiment wherein the pivotable member 12C of the connection member 1C is a disk-like member and has a first hole 121C, and the protrusion on the frame 2C is composed of two parts 21C with a slot defined therebetween, and each of the two parts has a second hole 211C. The pivotable member 12C is inserted into the slot between the two parts 21C of the protrusion and a bolt 15C extends through the first and second holes 121C, 211C and is connected with a nut.

Figure 14:
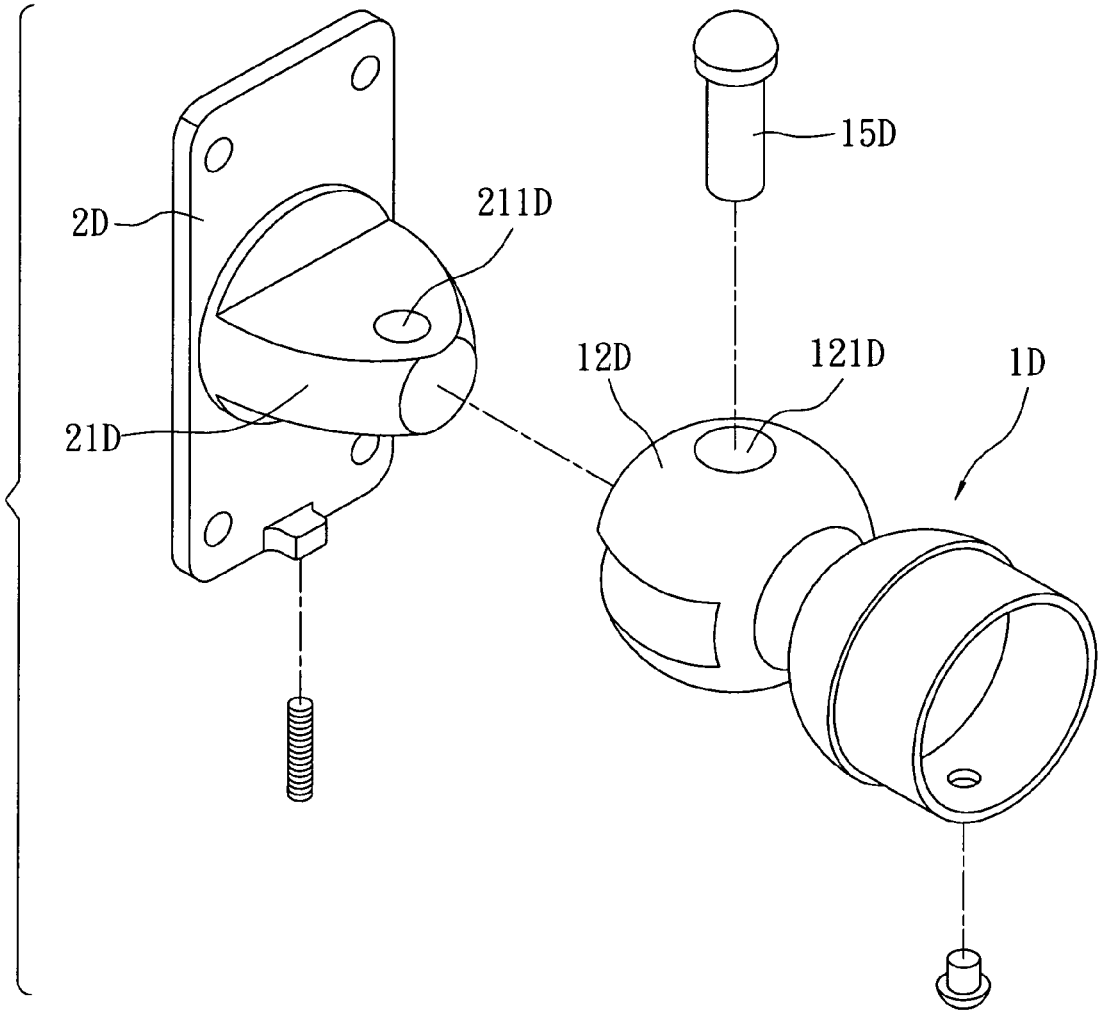
FIG. 14 shows another embodiment of the shower curtain rod assembly.

FIG. 14 shows another embodiment of the present invention wherein the pivotable member 12D of the connection member 1D is a ball-shaped member and has a slot so as to define two parts. A first hole 121D is defined through the two parts of the pivotable member 12D. The protrusion 21D on the frame 2D is a substantially triangular flat member and has a second hole 211D. The protrusion 21D is inserted into the slot between the two parts of the pivotable member 12D and a pin 15D extends through the first and second holes 121D, 211D.

While we have shown and described the embodiment in accordance with the present invention, it should be clear to those skilled in the art that further embodiments may be made without departing from the scope of the present invention.

What is claimed is:

1. A shower curtain rod assembly comprising:

a connection member having a connection tube which has one end connected with an end of a rod, a pivotable member connected to the other end of the connection tube, a shrink neck connected between the pivotable member and the connection tube;

a frame adapted to be fixed on a wall and having a protrusion which is pivotably connected to the pivotable member, and a cover having a through hole through which the connection tube extends, the shrink neck and the connection tube located outside of an outer surface of the cover, the cover having a first stepped member and a second stepped member formed on a rear side thereof the first stepped member being located between two clamp plates on the cover, the second stepped member having a threaded hole formed therein, two sides of the frame being clamped between the two clamp plates, a block extends from the frame and a bolt threadedly extends through the threaded hole and contacts against the block.

2. The assembly as claimed in claim 1, wherein the frame includes bosses extending from one of sides of the frame and the cover includes a peripheral wall which is mounted to the frame and the bosses frictionally connect the peripheral wall.

3. The assembly as claimed in claim 1, wherein the connection tube of the connection member has an extension portion which has a diameter smaller than a diameter of the connection tube.

4. The assembly as claimed in claim 3, a bolt extends through a wall of the extension portion so as to contact against the rod.

5. The assembly as claimed in claim 3, wherein a secure member has one end connected to the end of the rod and the other end of the secure member is inserted into the extension portion of the connection tube.

6. The assembly as claimed in claim 1, wherein the cover is a bowl-shaped member and a plurality of beads are connected along a periphery of the through hole, a plurality of ridges extend radially from the periphery of the through hole on the outer surface.

7. The assembly as claimed in claim 1, wherein the cover is a rectangular member and includes a plurality of reflection outer surface.

8. The assembly as claimed in claim 1, wherein the cover is an octagon-shaped member and the through hole is an octagon-shaped hole.

9. The assembly as claimed in claim 1, wherein the pivotable member includes two parts with a slot defined therebetween, each of the two parts has a first hole defined therethrough, the protrusion on the frame is inserted into the slot between the two parts of the pivotable member and has a second hole defined therethrough, a pin extends through the first and second holes.

10. The assembly as claimed in claim 1, wherein the pivotable member has a flat surface and a first hole is defined through the pivotable member, the protrusion on the frame has another flat surface which is matched with the flat surface of the pivotable member, the protrusion has a second hole defined therethrough, a bolt extends through the first and second holes and is connected with a nut.

11. The assembly as claimed in claim 1, wherein the pivotable member is a disk-like member and has a first hole defined through, the protrusion on the frame is composed of two parts with a slot defined between the two parts, each part has a second hole defined therethrough, a bolt extends through the first and second holes and is connected with a nut.

* * * * *